US005598197A

United States Patent [19]

Zaba

[11] Patent Number: 5,598,197

[45] Date of Patent: Jan. 28, 1997

[54] CONTINUOUS INK JET PRINTER

[75] Inventor: Jerzy M. Zaba, Cambridge, England

[73] Assignee: Domino Printing Sciences PLC, England

[21] Appl. No.: 778,224

[22] PCT Filed: Jul. 2, 1990

[86] PCT No.: PCT/GB90/01010

§ 371 Date: Dec. 12, 1991

§ 102(e) Date: Dec. 12, 1991

[87] PCT Pub. No.: WO91/00808

PCT Pub. Date: Jan. 24, 1991

[30] Foreign Application Priority Data

Jul. 11, 1989 [GB] United Kingdom ..... 8915819

[51] Int. Cl.[6] ..... B41J 2/03; B41J 2/165

[52] U.S. Cl. ..... 347/75; 347/22

[58] Field of Search ..... 347/22, 29, 44, 347/47, 54, 75

[56] References Cited

U.S. PATENT DOCUMENTS

| | | | |
|---|---|---|---|
| 3,972,474 | 8/1976 | Keur | 347/75 X |
| 3,974,508 | 8/1976 | Blumenthal | 347/22 |
| 4,199,767 | 4/1980 | Campbell et al. | 347/44 |
| 4,367,479 | 1/1983 | Bower | 347/30 |
| 4,458,255 | 7/1984 | Giles | 347/44 X |
| 4,500,894 | 2/1985 | Kirner | 347/29 |
| 4,628,330 | 12/1986 | Suga et al. | 347/54 |
| 4,780,728 | 10/1988 | Fost | 347/54 |
| 4,792,817 | 12/1988 | Barney | 347/4 |
| 4,930,700 | 6/1990 | McKown | 347/40 X |

*Primary Examiner*—Fred L. Braun

*Attorney, Agent, or Firm*—Laff, Whitesel, Conte & Saret, Ltd.

[57] ABSTRACT

A continuous ink jet printer printhead having an ink channel that is fed by an oscillator to a nozzle connected to the ink channel. A closer is connected within the printhead to close off the nozzle when the continuous jet ink printer is not in use.

7 Claims, 3 Drawing Sheets

CONTINUOUS INK JET PRINTER

The present invention relates to ink jet printers and, more particularly, to the printhead of a so-called continuous ink jet printer.

Printers of this type have a printhead with one or more nozzles connected to a supply of ink, a string of droplets being caused to flow from the nozzle or nozzles by means of an oscillator, usually a piezoelectric transducer. The row of droplets is directed towards a gutter, but selective droplets can be charged as they leave the nozzle and then deflected in an electric field in order to impinge on a substrate, individual droplets being charged appropriately in order to print at the correct position.

One particular problem with printers of this type is found with low viscosity inks which include a solvent component to enable relatively quick drying, and results from seepage of ink through the nozzle at the end of a printing run. Ink remaining in an ink passage to the nozzle can seep from the nozzle, the solvent from the ink then evaporating and leaving ink residues around the nozzle exit which can interfere with the correct direction of the ink stream when the printer is next started. Clearing such a printhead is time consuming and wasteful of operator time.

There is a need therefore to provide a system in which agglomerations of ink residues can be prevented from forming around the nozzle exit.

GB-A-2085807 discloses a continuous ink jet printer which has an external stopper to which is fixed a cleaning pad. The stopper covers the nozzle during periods of non-printing, and the nozzle is moved back and forth prior to printing so that the nozzle can be cleaned.

According to the present invention there is provided a printhead for a continuous ink jet printer, the printhead having an ink channel; a nozzle at one end of the ink channel; and, an oscillator disposed to cause ejection of ink in the channel through the nozzle in use; characterised by means provided internally of the printhead for closing off the nozzle from the channel to prevent seepage of ink therethrough during periods of non-printing.

In a first embodiment, the printhead body has a circular recess in an end face thereof, the oscillator being a circular piezoelectric transducer disposed in the recess so as to provide a short ink chamber adjacent the end face of the printhead body and being arranged to expand and contract in the direction of its axis when an excitation voltage is applied thereto. The ink channel connects with the recess for feeding ink thereto. A nozzle plate is detachably mounted on the end face of the body and has one or more nozzles. The means for closing off the nozzle or nozzles comprises a plunger carrying a closure member and sliding in a central bore. In this embodiment, the recess surrounds the central bore, being connected to it by a generally radial ink passageway. In this specification, "circular" is to be taken to include "annular".

In a second embodiment, a main channel extends substantially in alignment with the axis of the nozzle and a second channel extends to the nozzle inclined to the nozzle axis. Through this second channel, ink is arranged to pass and a piezoelectric crystal is arranged around the second channel to cause it to be squeezed when the piezoelectric vibrates, and the means for closing off the nozzle comprises a plunger carrying a closure member and sliding in the first channel to close off the inlet end of the nozzle.

Alternatively, the oscillator may be a rod of piezoelectric material which, when a modulated electrical signal is fed to it, vibrates to cause vibration of the ink in the channel and thus ejection of the ink through the nozzle at a predetermined frequency. In a third embodiment of the present invention, the means for sealing off the nozzle from the channel comprises a closure member mounted on the end of the piezoelectric rod adjacent the nozzle and the piezoelectric rod is movable into engagement with the inlet end of the nozzle so that the closure member closes the nozzle to prevent further emission of ink.

Three examples of printheads constructed in accordance with the present invention will now be described with reference to the accompanying drawings, in which.

Figure 1:
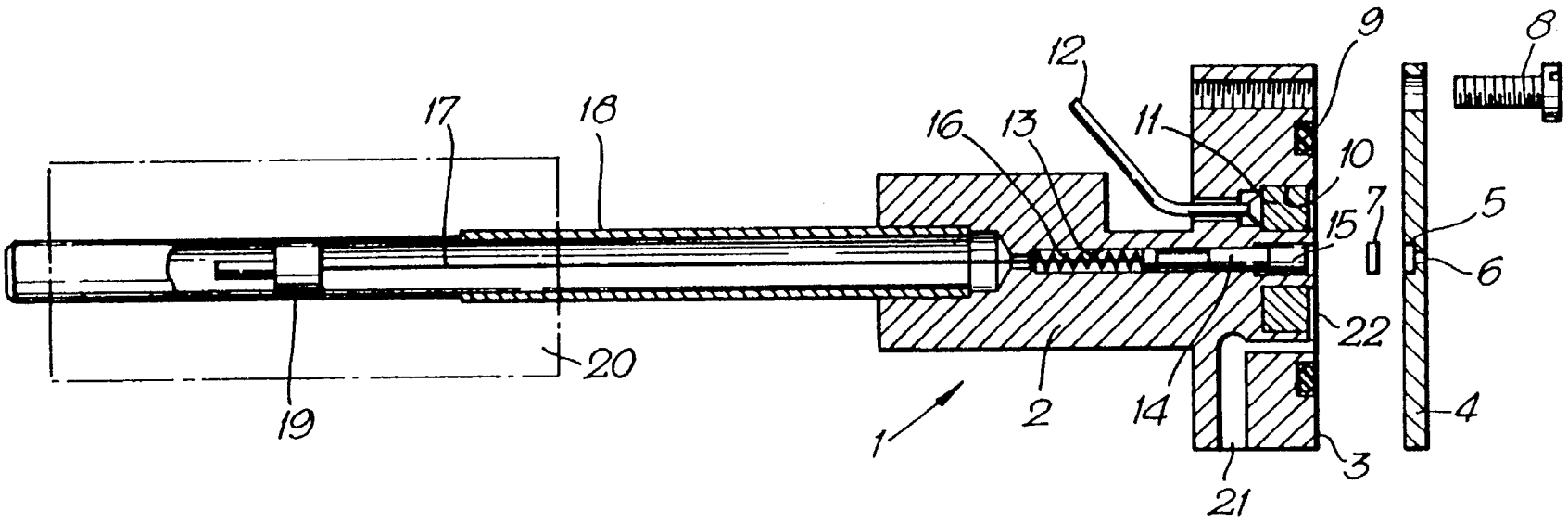
FIG. 1 is an exploded partial longitudinal cross-sectional view through a first example of a printhead.

FIG. 1 shows a printhead 1 having a body 2, to an end face 3 of which is fitted a nozzle plate 4 having a recess 5 and an ink ejection channel 6, with a jewelled nozzle 7 being received therein. The figure shows these components in an exploded arrangement for clarity. The nozzle plate 4 is clamped to the body 2 by means of appropriate bolts 8. A synthetic rubber O-ring 9 seals the nozzle plate 4 to the end face 3.

An annular bore 10 houses a likewise annular piezoelectric transducer 11 which is actuated by an excitation voltage supplied through a wire 12. The piezoelectric transducer is recessed, as shown, from the end face 3 so as to leave a thin annular gap of less than 0.5 mm, for ink.

Centrally disposed within the annular recess is a bore 13 which contains a plunger 14 carrying a closure member 15 for closing off the nozzle 7 when the printer is inactive. The plunger 14 is actuated by a solenoid 20 via an armature 19 and a connecting wire 17 sliding in a flexible tube 18. The plunger is biased forwards by a coil spring 16.

An ink supply passage 21 feeds ink from a reservoir (not shown) to the disk-like chamber 22, from where ink is passed to the end of the bore 13, between the closure member 15 and the nozzle 7.

In use, excitation of the piezoelectric transducer modulates the pressure of ink (or other fluids) to be printed, in the chamber 22, causing pressure fluctuations which in turn, after ink has been ejected through the jewelled nozzle 7, cause the stream of ink to break up into droplets.

Figure 2:
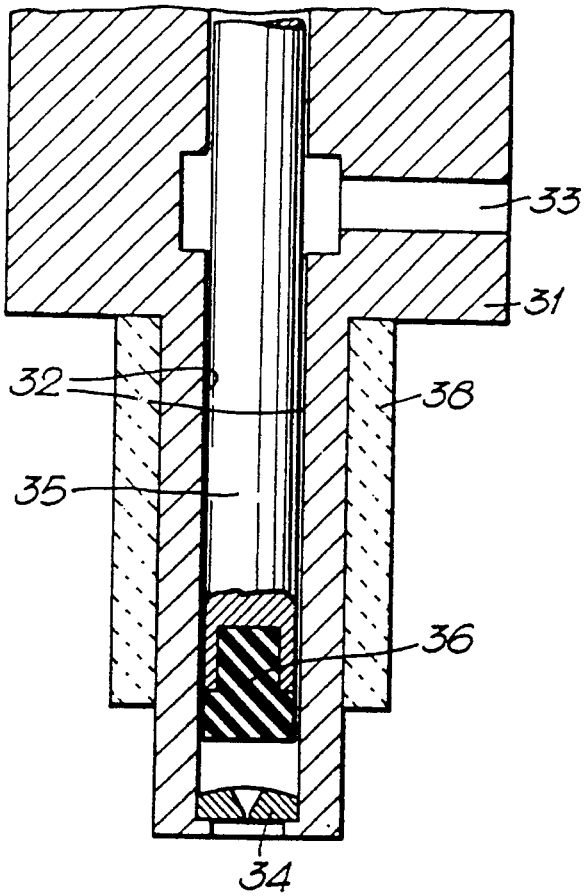
FIG. 2 illustrates, in cross-section, a portion of a second example of a printhead.

FIG. 2 shows a different construction of the printhead, in which ink is fed through a single channel 32 from a supply channel 33, the ink being fed around the sides of a cylindrical plunger 35 to the nozzles 34. The channel 32 houses the plunger 35. The piezoelectric oscillator 38 is again annular and is disposed around the extension 37.

As in the first example, when the printer is shut down or switched off the plunger 35 and its closure member 36 are moved into engagement with the inside of the nozzle 34, thereby closing off the nozzle from the ink supply and preventing leakage of ink through the nozzle during periods of non-use of the printer. The plunger 35 may be solenoid operated.

Before printing is next commenced the control routine of the printer causes the plunger and actuator to be removed from the rear of the nozzle thus opening the nozzle to the supply of ink.

Figure 3:
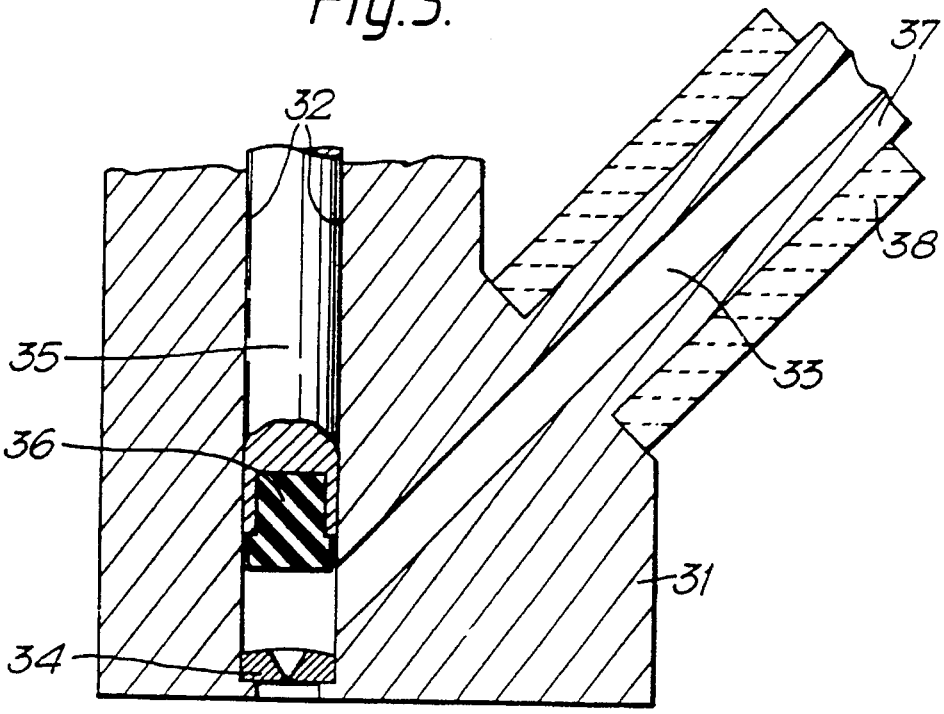
FIG. 3 illustrates a similar cross-sectional view of a third printhead.

A third example of a printhead is shown in FIG. 3 and comprises a body 31 formed of a synthetic plastics material such as Ryton, and has a first channel 32 and a second channel 33, the second channel joining with the first channel close to its exit from the body.

At the exit point of the channel 32 a jewelled nozzle 34 is fixedly mounted. Slidably disposed within the channel 32 is a plunger 35 carrying a synthetic rubber closure member 36. Mounted around an extension 37 of the body 31 is an annular piezoelectric transducer 38.

In use an electrical signal applied to the piezoelectric transducer 38 causes it to vibrate in a radial mode, thus squeezing the extension 37 and, in turn, applying pressure to ink residing within the channels 32 and 33. Ink is fed to the body 31 through the open end of the channel 33 by means of a conventional feed tube or the like (not shown) and the pulsing of the ink pressure causes ink to be ejected through the nozzle 34 in a continuous stream of droplets.

Operation to close off the rear of the nozzle is as described above.

Figure 4:
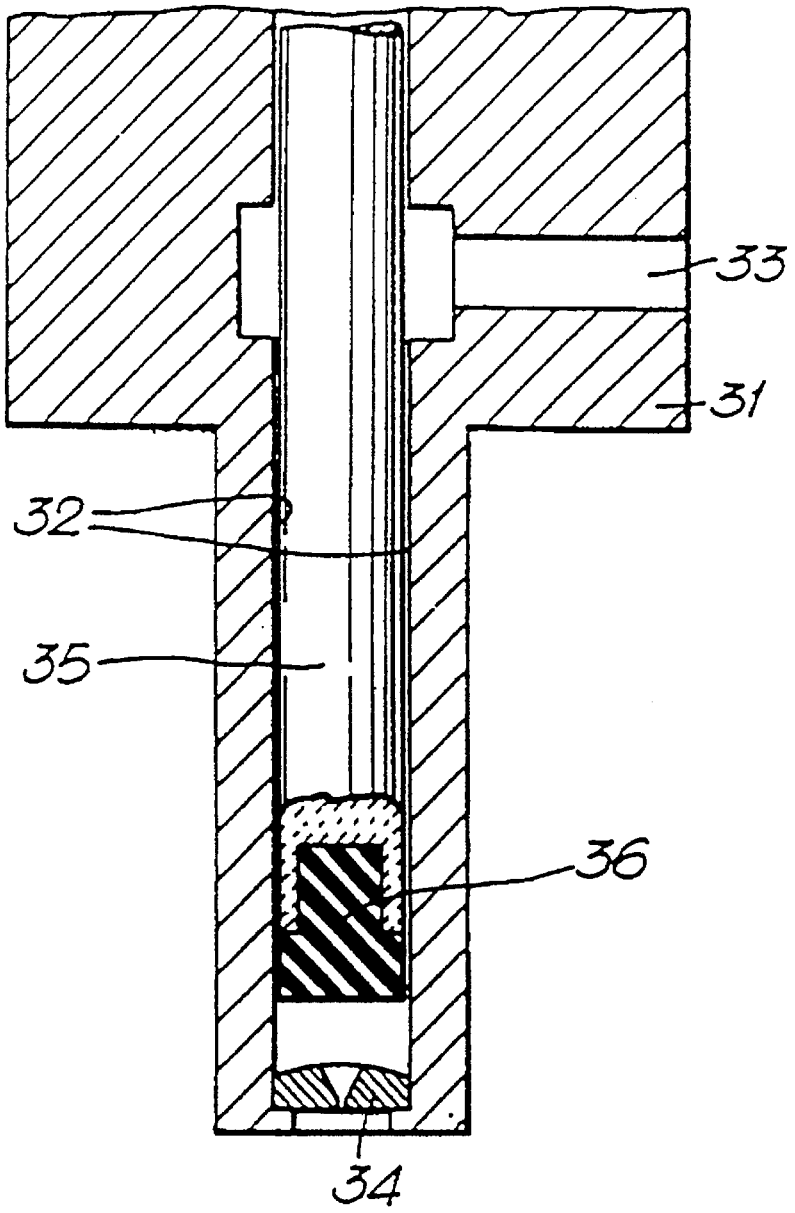
FIG. 4 illustrates a portion of a fourth example of a printhead.

A further embodiment, shown in FIG. 4 of the drawings, comprises a printhead similar in design to the above FIG. 2 wherein the plunger is a conventional piezoelectric rod vibrating inside the body to cause the emission of ink through the nozzle, the piezoelectric rod has a closure member 36 on its end adjacent the nozzle and being arranged to be movable bodily into engagement with the rear of the nozzle to close off the nozzle.

The arrangement for charging and deflecting the droplets may be conventional in each example and forms no part of this invention.

I claim:

1. A continuous ink jet printer printhead (1), the printhead having an ink channel (22,32,33); a nozzle (4,34) at one end of the ink channel (22,32); and, an oscillator (11,38) disposed to cause ejection of ink in the channel (22,32,33) through the nozzle (4,34) in use; characterised by means (14,15,35,36) provided internally of the printhead for closing off the nozzle (4,34) from the channel (22,32) to prevent seepage of ink therethrough during periods of non-printing.

2. A printhead according to claim 1, wherein the means (14,15,35,36) for closing off the nozzle (4,34) comprises a plunger (14,35) carrying a closure member (15,36).

3. A printhead according to claim 2, wherein the printhead (1) has an oscillator (11,38) surrounding a central bore (13,32), the plunger (14,35) and closure member (15,36) being slidable within the bore (13,32), ink passing during printing through at least part of the bore (13,32).

4. A printhead according to claim 3, wherein the ink is fed in use around the sides of the plunger (35) to the nozzle (34).

5. A printhead according to claim 2, wherein the printhead (1) has a main channel (32) in alignment with the axis of the nozzle (34) and a second channel (33) extending to the nozzle (34) and inclined to said axis, the oscillator (38) surrounding at least part of the second channel (33), the plunger (35) and closure member (36) being slidable within the main channel (32).

6. A printhead according to any of claims 2 to 5, wherein the plunger is operable by a solenoid (20) via an armature (19).

7. A printhead for a continuous ink jet printer, the printhead having an ink channel; a nozzle at one end of the ink channel; and, an oscillator disposed to cause ejection of ink in the channel through the nozzle in use; characterized by means provided internally of the printhead for closing off the nozzle from the channel to prevent seepage of ink therethrough during periods of non-printing wherein the oscillator is substantially cylindrical and vibrates within the ink channel in use, the means for closing off the nozzle from the ink channel being a closure member attached to or integral with the oscillator, the oscillator being movable bodily into engagement with the rear of the nozzle.

* * * * *